United States Patent [19]

Douty et al.

[11] 4,367,005

[45] Jan. 4, 1983

[54] STRAIN RELIEF COVER

[75] Inventors: George H. Douty, Mifflintown; Clair W. Snyder, Jr., York, both of Pa.

[73] Assignee: AMP Incorporated, Harrisburg, Pa.

[21] Appl. No.: 204,145

[22] Filed: Nov. 5, 1980

[51] Int. Cl.[3] ..... H01R 13/58

[52] U.S. Cl. ..... 339/107

[58] Field of Search ..... 339/103 R-107

[56] References Cited

U.S. PATENT DOCUMENTS

| | | | |
|---|---|---|---|
| 3,854,787 | 12/1974 | Snyder | 339/103 R |
| 3,858,960 | 1/1975 | Kunkle et al. | 339/103 |
| 3,879,099 | 4/1975 | Shaffer | 339/107 X |
| 3,904,265 | 9/1975 | Hollyday et al. | 339/103 M |
| 4,169,648 | 10/1979 | Moist, Jr. | 339/103 R |
| 4,269,466 | 11/1979 | Huber | 339/107 |
| 4,280,746 | 7/1981 | Ignatowicz | 339/107 |

*Primary Examiner*—Eugene F. Desmond

*Attorney, Agent, or Firm*—Russell J. Egan

[57] ABSTRACT

A strain relief cover is disclosed formed of a pair of mating hermaphroditic members of molded plastics material. Each cover member has a plurality of discrete digits which extend forwardly from a mating end to interengage with appropriate terminal recesses in an associated connector housing to secure one end of each cover member thereto. Each cover member also includes a profiled cable gripping portion having interdigitated integral teeth which form a tortuous path for a cable and/or conductors to securely grip them therebetween. The cover members further include latching arms and shoulders towards an opposite rear end which interengage to secure the cover members together.

4 Claims, 5 Drawing Figures

Fig. 2
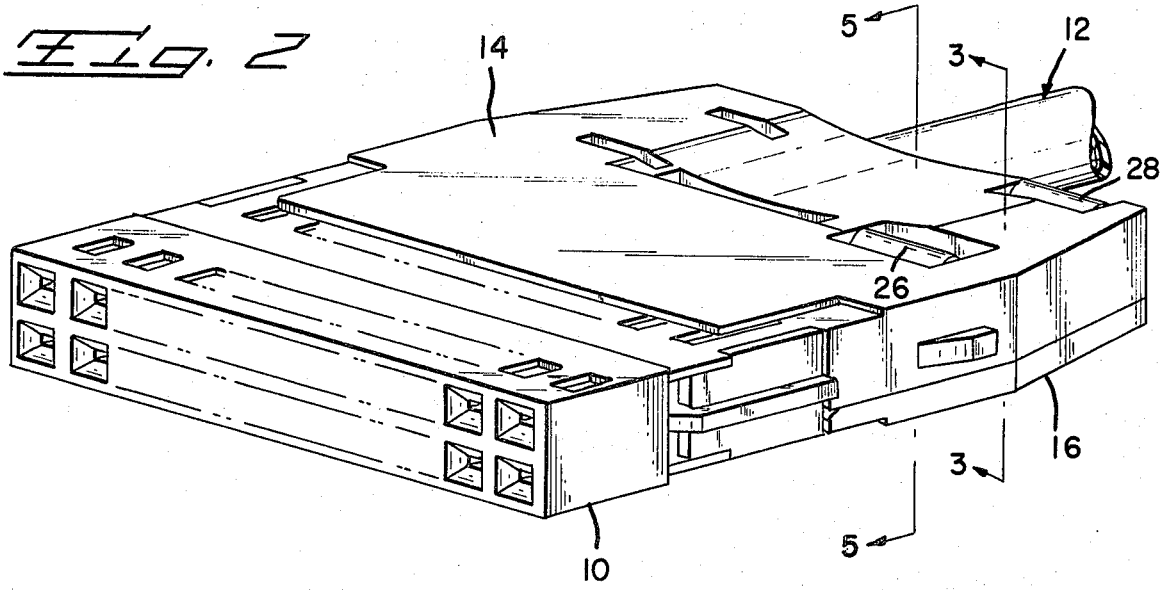
Fig. 3
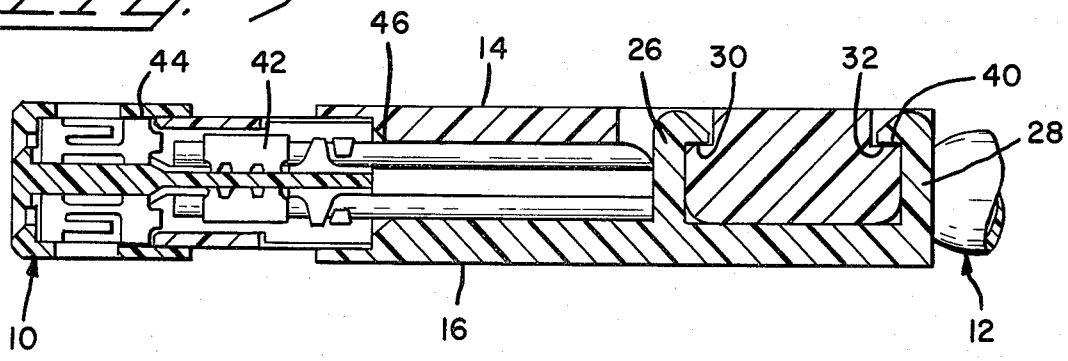
Fig. 4
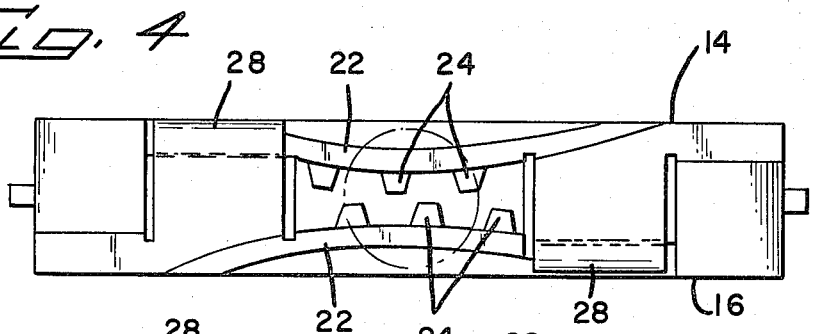
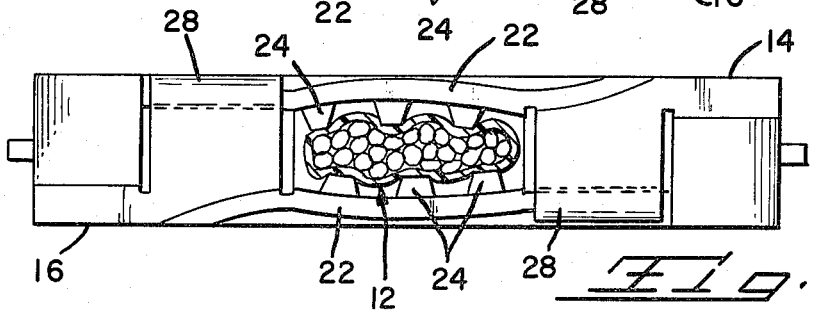
Fig. 5

STRAIN RELIEF COVER

BACKGROUND OF THE INVENTION

1. The Field Of The Invention

The present invention relates to a strain relief cover to be used in conjunction with an electrical connector and in particular to a strain relief formed by a pair of mating hermaphroditic members.

2. The Prior Art

The prior art is best represented by U.S. Pat. Nos. 3,858,960; 3,904,265 and 4,169,648. The first and last of these patents show hermaphroditic members which are selectively attached to a known electrical connector and are bolted together to form a cable strain relief. The other patent shows a cable strain relief formed by a pair of mating members which are hingedly attached at one edge, bolted together at an opposite edge and grip a connector by an intermediate edge. Closure of the members causes clamping of the cable in each of these instances.

SUMMARY OF THE INVENTION

The present invention concerns a strain relief assembly for use with a known electrical connector and with the subject assembly being formed by a pair of hermaphroditic cover members. The cover members are so formed as to have a plurality of interdigitating integral teeth which form a tortuous path for a cable formed either by a plurality of conductors contained within a sheath or a cable formed by a plurality of individual conductors. The portion of the hermaphroditic cover member containing the teeth has an inwardly bowed configuration which aids in applying compressive force to the cable. Also, the force of the engagement with the cable will cause a slight reverse of the inward bowing but not to a sufficient degree that it will exceed the normal exterior dimensions of the cover members. Thus, a low profile may be achieved by the subject assembly. The cover members also have a plurality of teeth along a mating edge adapted to engage in terminal passages of an associated connector as well as latching means on an opposite edge adapted to interengage and secure the cover members together.

It is therefore an object of the present invention to produce a strain relief assembly formed by a pair of hermaphroditic members which are snapped together so that no additional hardware is necessary.

It is a further object of the present invention to produce an improved strain relief which will have a low profile so as to allow minimal spacing between adjacent connectors.

It is another object of the present invention to produce a strain relief assembly formed by a pair of hermaphroditic cover members having a plurality of teeth which combine in an interdigitated fashion to form a tortuous path for the cable so that a cable of conductors enclosed in a sheath or a cable of individual conductors without a sheath may both be provided with strain relief.

It is a further object of the present invention to produce an improved strain relief assembly which can be readily and economically manufactured.

The means for accomplishing the foregoing objects and other advantages of the present invention will become apparent to those skilled in the art from the following detailed description taken with reference to the accompanying drawings.

BRIEF DESCRIPTION OF THE DRAWINGS

FIG. 2 is a perspective view of a subject invention assembled on the connector and cable of FIG. 1;

FIG. 3 is a longitudinal section taken along line 3—3 of FIG. 2;

FIG. 4 is a transverse section taken along line 5—5 showing the subject strain relief assembly without a cable in place; and FIG. 5 is a transverse section taken along line 5—5 showing the subject strain relief assembly with a cable in place.

DETAILED DESCRIPTION OF THE PREFERRED EMBODIMENT

Figure 1:
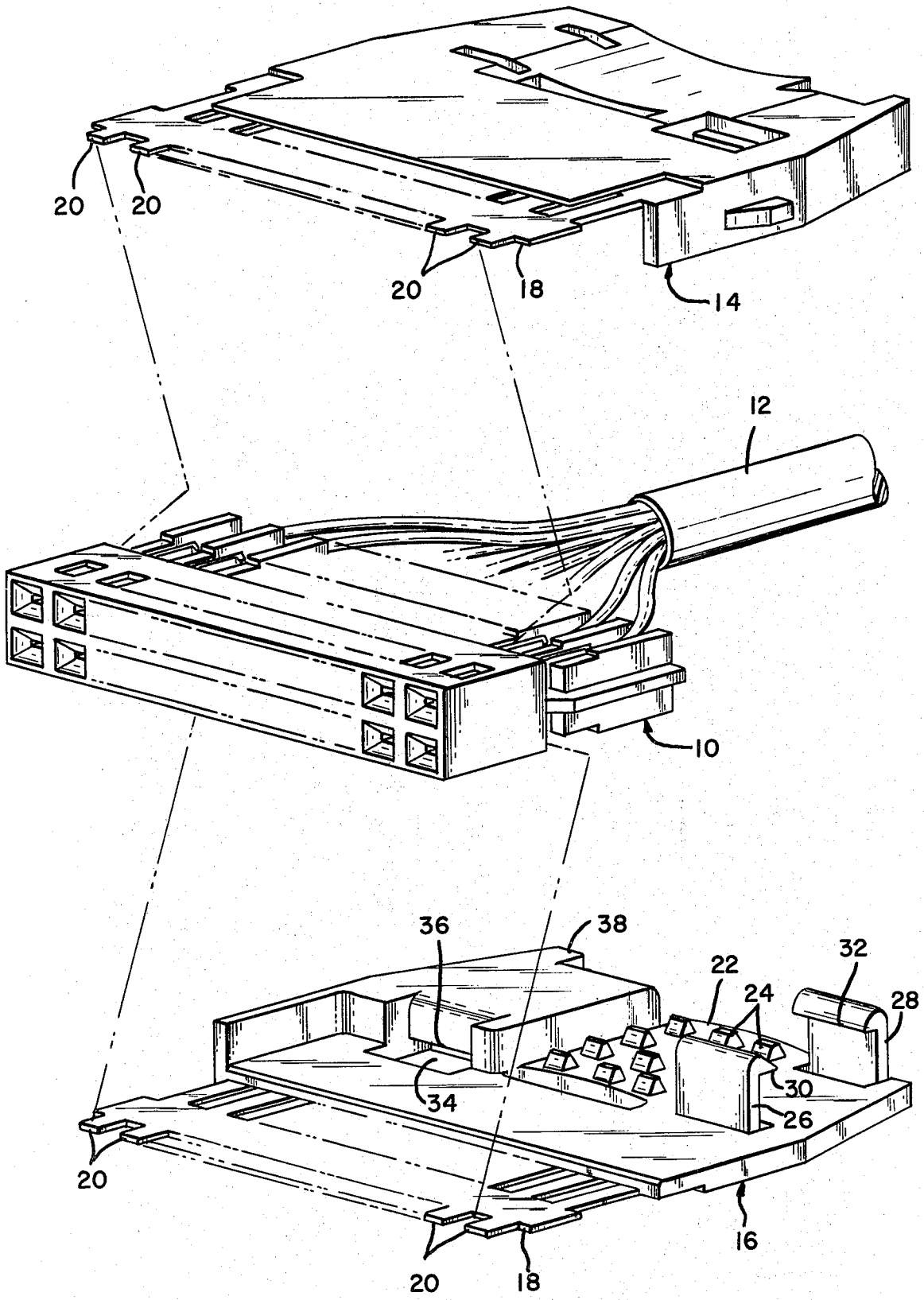
FIG. 1 is an exploded perspective view of the subject strain relief assembly together with a known electrical connector and cable.

The connector 10 shown terminating a cable 12 is of a known type described in U.S. Pat. No. 4,243,288, the disclosure of which is incorporated herein by reference. The subject strain relief assembly comprises a pair of hermaphroditic cover members 14, 16. Each of the cover members 14, 16 has a forward mating edge 18 with a plurality of tongues 20 projecting therefrom in parallel spaced relation. Each cover member 14, 16 also includes an inwardly bowed, conductor gripping portion 22 having a plurality of inwardly directed, integral teeth 24 thereon. It should be noted that since the cover members are hermaphroditic the teeth are staggered with respect to each other so as to form an interdigitating pattern as can best be appreciated from FIGS. 4 and 5. It should also be noted that the shape of the teeth is of little consequence to the functionality of the invention. Each cover member further includes, to one side of a rear edge, a pair of depending latching legs 26, 28 each with an inwardly directed shoulder 30, 32 at the free end. The members also includes, to the opposite side of the rear edge, an aperture 34 defining a shoulder 36 and a rearwardly directed recess 38 defining a shoulder 40.

The subject strain relief is applied to a connector 10 in the following manner. The terminals 42 are preloaded into the terminal passages 44 of the connector housing 10. The individual conductors 46 of cable 12 are terminated by applying them to the respective terminals 42 in an insulation piercing fashion, as described in the above mentioned patent application Ser. No. 053,150. The forward mating edges 18 of the cover members 14, 16 are applied to the connector 10 with the tongues 20 projecting into the terminal passages 44, as best seen in FIG. 3. The cover members 14, 16 are then rotated about the housing 10 to come into a closed condition, as shown in FIGS. 2 and 3, with the legs 26 passing through apertures 34 and the legs 28 passing down the recess 38 so that the shoulders 30, 36 and 32, 40 engage, as shown in FIG. 3. In this condition adequate pressure is applied to the cable 12 and the individual conductors thereof by the gripping portions 22 and teeth 24 to provide for strain relief.

The present invention may be subject to many modifications and changes without departing from the spirit or essential characteristics thereof. The present embodiment is therefore intended in all respects to be illustrative and not restrictive of the scope of the invention.

What is claimed is:

1. In combination with an elongated electrical connector of rigid insulative material having a plurality of terminal receiving passages each having therein a respective terminal terminating a respective conductor of a cable formed by a plurality of individual conductors held in a circular configuration by an outer jacket, a strain relief assembly providing a low profile and comprising:

a pair of hermaphroditic cover members of rigid insulative material, each said cover member having a forward mating edge with a plurality of parallel spaced tongues projecting therefrom for reception in said terminal passages of said connector, latching means at opposite ends of a rearwardly spaced edge to latchingly secure said cover members together and passage means centrally of said latching means and having an inwardly directed arcuate portion on each said cover member, said inwardly directed arcuate portion becoming slightly reversedly bowed when engaged with a cable, but remaining within the overall configuration of said cover member, to grip said cable so that when said cover members have their mating ends inserted in said connector and said latching members engaging said cable gripping means applies sufficient strain relief force to the cable.

2. The combination according to claim 1 wherein said cable gripping means comprises a plurality of inwardly directed individual integral teeth which, when the cover members are joined together, form an interdigitated tortuous path for said cable.

3. The combination according to claim 1 wherein said latching means comprises at least one leg integral with each said cover member and extending normally therefrom, each said leg having a shoulder at a free end thereof, and an aperture defining a shoulder at a position where it will be engaged by said shoulder of said leg upon mating of said cover members.

4. A strain relief assembly for round electrical cable providing a low profile, said assembly comprising:

a pair of hermaphroditic profiled covers each intended for engagement against opposite sides of said cable in opposition to the other of said covers, each cover having an inwardly directed arcuate portion which engages the cable and is slightly reversedly bowed outwardly by the cable to accommodate its passage therebetween, said arcuate portion not exceeding the cover profile in the reversedly bowed condition, a plurality of inwardly directed integral teeth on said arcuate portions forming an interdigitated tortuous path for said cable, each cover having a forward mating edge adapted to engage respective sides of an electrical connector and latching means at opposite rear corners.

* * * * *